US010281131B2

(12) United States Patent
Cohen

(10) Patent No.: US 10,281,131 B2
(45) Date of Patent: May 7, 2019

(54) HEAT DISPERSION ELEMENT

(71) Applicant: Brandon Cohen, Vernon, CA (US)

(72) Inventor: Brandon Cohen, Vernon, CA (US)

( * ) Notice: Subject to any disclaimer, the term of this patent is extended or adjusted under 35 U.S.C. 154(b) by 85 days.

(21) Appl. No.: 15/474,680

(22) Filed: Mar. 30, 2017

(65) Prior Publication Data

US 2018/0283677 A1 Oct. 4, 2018

(51) Int. Cl.
*F21V 29/77* (2015.01)
*F21V 29/89* (2015.01)

(52) U.S. Cl.
CPC ..... *F21V 29/773* (2015.01); *F21V 29/89* (2015.01)

(58) Field of Classification Search
CPC ..... F21V 29/773; F28F 2013/006; F28F 2215/14
USPC ..... 165/80.1
See application file for complete search history.

(56) References Cited

U.S. PATENT DOCUMENTS 9,238,262 B2 * 1/2016 Lin ..... B21D 53/02
2014/0199168 A1 * 7/2014 Spiro ..... F04D 29/582 416/5
2014/0334153 A1 11/2014 Creusen
2015/0377473 A1 * 12/2015 Ha ..... F21V 29/713 362/382
2016/0223185 A1 * 8/2016 Harvey ..... F21L 4/00

* cited by examiner

*Primary Examiner* — Diane I Lee
*Assistant Examiner* — Keith G. Delahoussaye
(74) *Attorney, Agent, or Firm* — Eric Kelly

(57) ABSTRACT

Heat-dispersion-elements for cooling light-module-inserts, as well as methods for cooling and systems for cooling are described. The heat-dispersion-element may have an outer arc and disposed opposite an inner arc. At least portions of the outer arc may be in direct physical contact with at least some portions of inside-surfaces of a housing. At least portions of the inner arc may be in direct physical contact with at least some portions of outside-surfaces of the light-module-insert. The heat-dispersion-element may be located between the light-module-insert and the housing. The heat-dispersion-element may have an overall torus or torus like shape, or a partial torus like shape. The heat-dispersion-element may have a base and fingers extending from that base. The base may be curved into the outer arc. The fingers may be curved to form the inner arc.

15 Claims, 10 Drawing Sheets

HEAT DISPERSION ELEMENT

TECHNICAL FIELD OF THE INVENTION

The present invention relates in general to heat dispersion elements and more specifically to heat dispersion elements disposed between a light module and its housing; wherein the heat dispersion element is used to cool the light module.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Presently light-module-inserts are often housed within a housing, such as in recessed lighting applications. Such light-module-inserts, as electrical components, often generate heat. Over time, such generated heat may shorten the overall effective lifespan of such light-module-inserts. Over time, such generated heat may decrease operational efficiencies of such light-module-inserts. Over time, such generated heat may increase operational costs for running and using such light-module-inserts. Particularly in commercial and industrial buildings, where hundreds or thousands of such light-module-inserts may be utilized, increases in operational costs and shortening of effective life spans may be significant. Additionally, such generated heat may pose fire risks.

There is a need in the art to sufficiently cool such light-module-inserts, which significantly increasing costs.

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describes heat-dispersion-elements for cooling light-module-inserts, as well as methods for cooling and systems for cooling. In some embodiments, the heat-dispersion-element may comprise an outer arc and disposed opposite an inner arc. In some embodiments, at least portions of the outer arc may be in direct physical contact with at least some portions of inside-surfaces of a housing. In some embodiments, at least portions of the inner arc may be in direct physical contact with at least some portions of outside-surfaces of the light-module-insert. In some embodiments, the heat-dispersion-element may be disposed between the light-module-insert and the housing. In some embodiments, the heat-dispersion-element may have an overall torus or torus like shape, or a partial torus like shape. In some embodiments, the heat-dispersion-element may comprise a base and fingers extending from that base. In some embodiments, the base may be curved into the outer arc. In some embodiments, the fingers may be curved to form the inner arc.

It is an objective of the present invention to provide heat-dispersion-elements that may be located between a housing a light-module-insert that would typically be housed within said housing.

It is another objective of the present invention to provide the heat-dispersion-element to cool the light-module-insert.

It is another objective of the present invention to extend the useful life of the light-module-insert by cooling the light-module-insert via use of one or more heat-dispersion-elements.

It is another objective of the present invention to increase operational efficiency of the light-module-insert by cooling the light-module-insert via use of one or more heat-dispersion-elements.

It is another objective of the present invention to decrease operational cost of the light-module-insert by cooling the light-module-insert via use of one or more heat-dispersion-elements.

It is another objective of the present invention to reduce fire risks by cooling the light-module-insert via use of one or more heat-dispersion-elements.

It is another objective of the present invention to provide heat-dispersion-elements that are easy and affordable to manufacture.

It is yet another objective of the present invention to provide heat-dispersion-elements that are easy and simple to use and install.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 5A also show DETAIL 5B.

REFERENCE NUMERAL SCHEDULE

Figure 1:
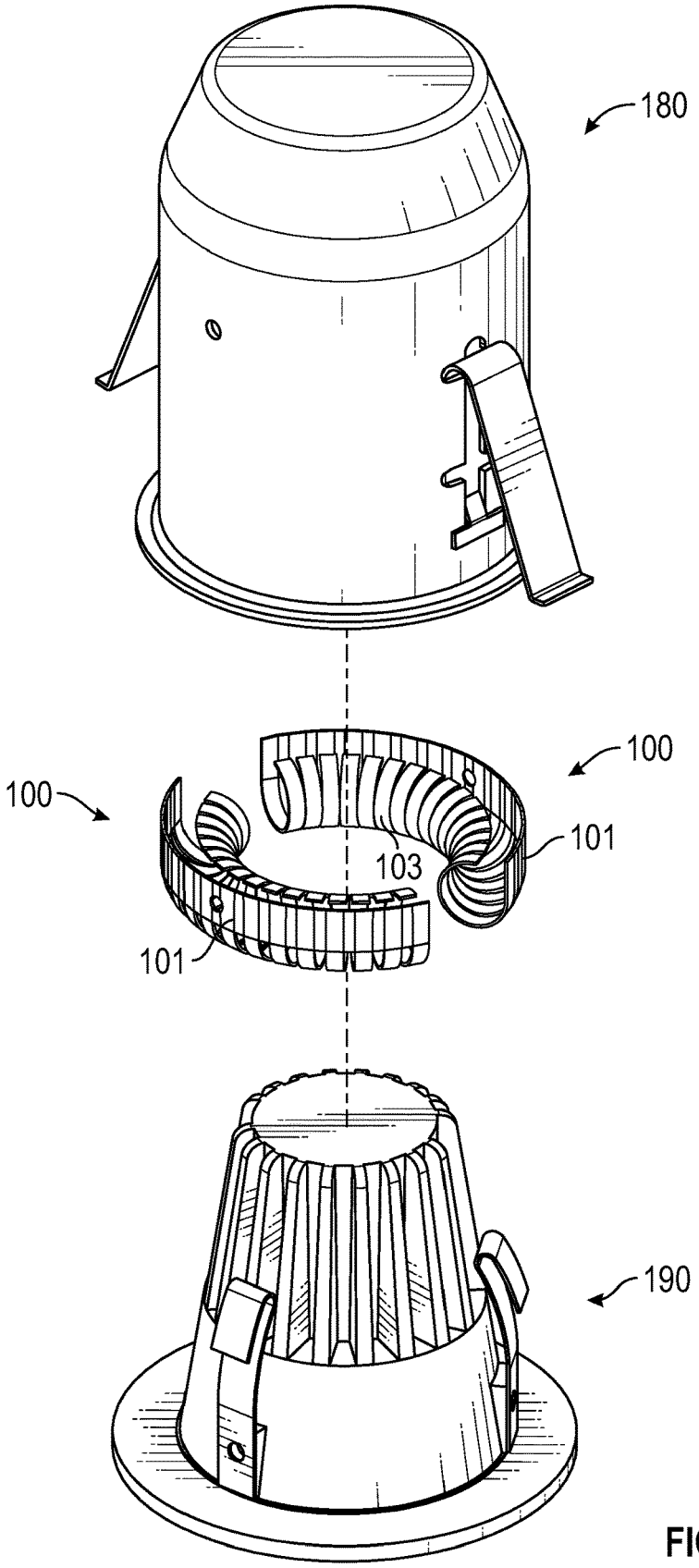
FIG. 1 may depict an exploded perspective view of a light-module-insert, heat-dispersion-elements, and a housing.

100 heat-dispersion-element 100
101 outer arc 101
103 inner arc 103
180 housing 180
190 light-module-insert 190
191 fin 191
281 housing-inside-surface 281
301 base 301
303 finger 303
305 fin-engagement-region 305
307 engagement-region 307
309 attachment-region 309
311 angle-of-arc 311
400 heat-dispersion-element 400
401 base 401
403 finger 403
415 first-end 415
417 second-end 417
421 base-length 421
423 finger-length 423
591 light-module-insert-outside-surface 591
615 first-end 615
617 second-end 617
625 separation-gap 625
627 void-space-region 627
731 radiant-heat-direction 731
733 conductive-heat-direction 733
735 convective-direction 735

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1 may depict an exploded perspective view of a light-module-insert 190, heat-dispersion-elements 100, and a housing 180. In some embodiments, a given light-module-insert 190 may be housed, inserted, and/or mounted within a given housing 180. See e.g., FIG. 5A and FIG. 1. Because such housings 180 and such light-module-inserts 190 may generally be cylindrical and/or conical, when a given light-module-insert 190 may be inserted into the given housing 180, an annular ring region of void space may exist disposed between housing-inside-surface 281 and light-module-insert-outside-surface 591 (which might be fins 191 of the given light-module-insert 190). See e.g., FIG. 2C, FIG. 5A, and FIG. 5B. In some embodiments, one or more heat-dispersion-elements 100 may occupy portions of this annular ring region of void space. See e.g., FIG. 1 and FIG. 5A. In some embodiments, such positioned heat-dispersion-elements 100 may physically contact portions of the given housing 180 (e.g., housing-inside-surface 281) and may also physically contact portions of the given light-module-insert 190 (e.g., fins 191 and/or light-module-insert-outside-surface 591). See e.g., FIG. 1, FIG. 2B, FIG. 2C, FIG. 5A, FIG. 5B, and FIG. 8.

In some embodiments, during normal operation, as an electrical component, light-module-insert 190 may generate heat. Over time, such generated heat may reduce a lifespan of the given light-module-insert 190. Over time, such generated heat may reduce operational efficiencies of the given light-module-insert 190. Such generated heat may also pose a fire hazard.

However, by locating one or more heat-dispersion-elements, such as heat-dispersion-elements 100, between and in physical contact with housing-inside-surface 281 and light-module-insert-outside-surface 591, at least some such generated heat from light-module-insert 190 may be dispersed away from light-module-insert 190. Thus, proper use of such placed one or more heat-dispersion-elements, such as heat-dispersion-elements 100, may increase the operational lifespan of light-module-insert 190; may increase operational efficiencies of light-module-insert 190; and/or may help to reduce fire hazard risks from heat generated by light-module-insert 190.

Figure 2A:
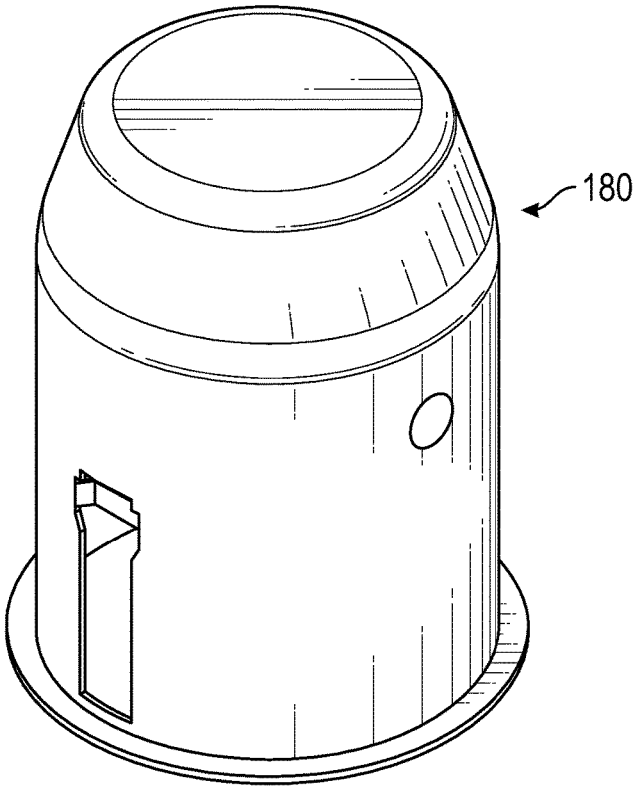
FIG. 2A may depict a top perspective view of a housing.
Figure 2B:
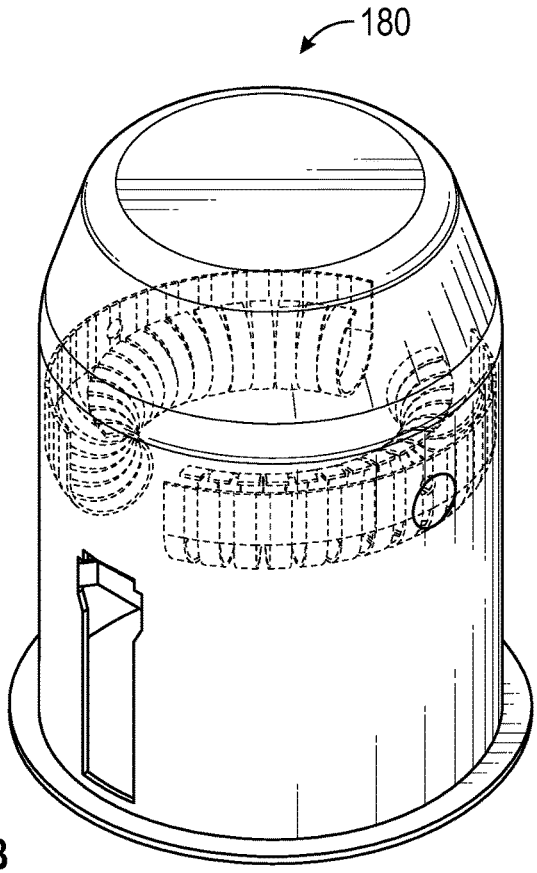
FIG. 2B may depict a top perspective view of the housing of FIG. 2A, but wherein heat-dispersion-elements are shown located within the housing, wherein the heat-dispersion-element are shown as transparent.

FIG. 2A may depict a top perspective view of housing 180. FIG. 2B may depict a top perspective view of housing 180, but wherein heat-dispersion-elements 100 may be shown located within housing 180, wherein the heat-dispersion-element 100 may be shown as transparent, using broken lines.

Note, housing 180 as shown in FIG. 2A and as shown in FIG. 1 may be different types of housings. However, a given heat-dispersion-element 100 may be successfully used in a variety of housings 180 and with a variety of light-module-inserts 190.

Figure 2C:
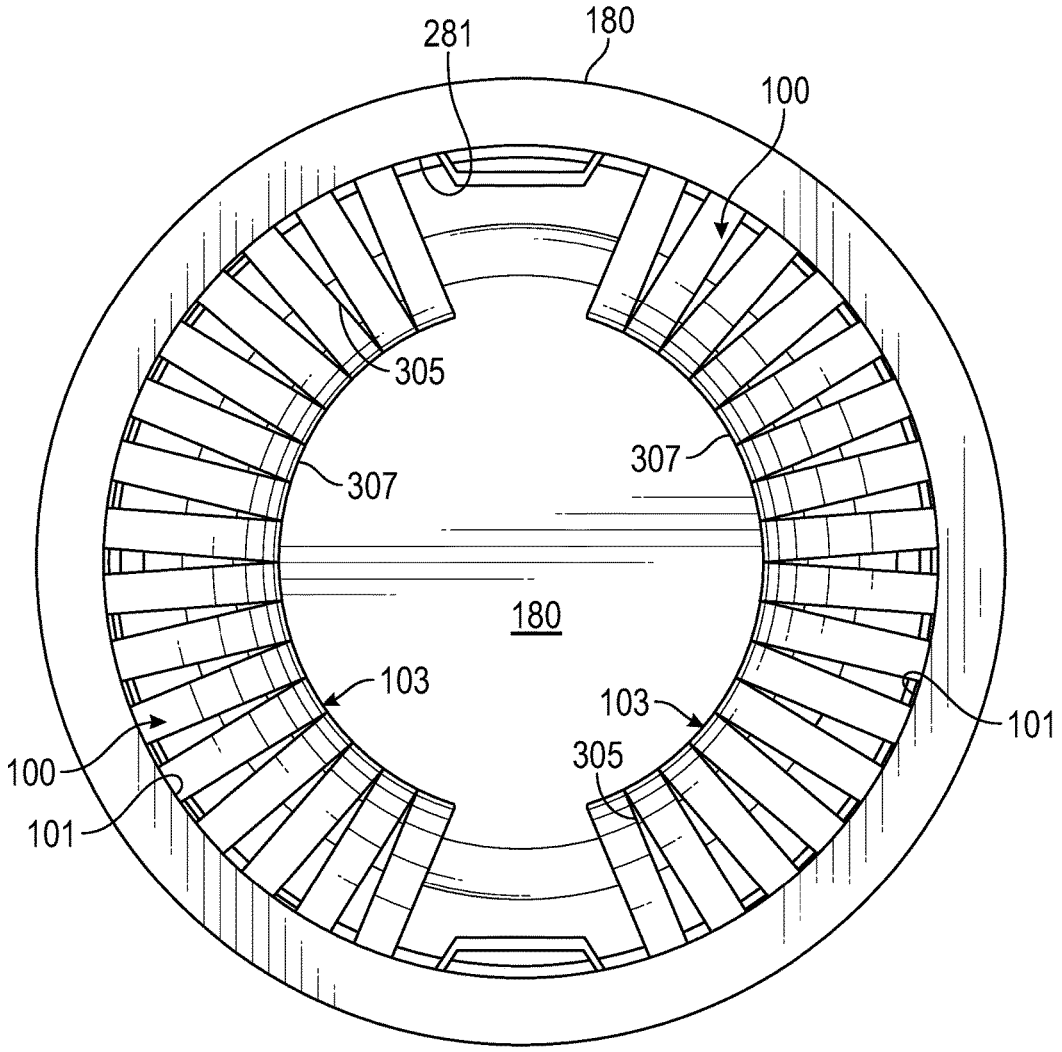
FIG. 2C may depict a bottom view of FIG. 2B, showing the heat-dispersion-elements located inside of the housing.

FIG. 2C may depict a bottom view of FIG. 2B, showing heat-dispersion-elements 100 located inside of housing 180. In some embodiments, outer arc 101 portions of a given heat-dispersion-element 100 may be in physical contact with portions of housing-inside-surface 281.

In some embodiments, a given heat-dispersion-element 100 may be mounted to (attached to) a given housing 180. In some embodiments, heat-dispersion-element 100 may comprise attachment-region 309. See e.g., FIG. 3B. In some embodiments, attachment-region 309 may be used to attach heat-dispersion-element 100 to housing-inside-surface 281. In some embodiments, attachment-region 309 may be a through hole through base 301 of heat-dispersion-element 100. In some embodiments, various mechanical fasteners may be used to attach attachment-region 309 to housing 180. In some embodiments, such mechanical fasteners may comprise one or more of: screws, bolts, snaps, buttons, rivets, press fits, friction fits, and/or the like.

Figure 3A:
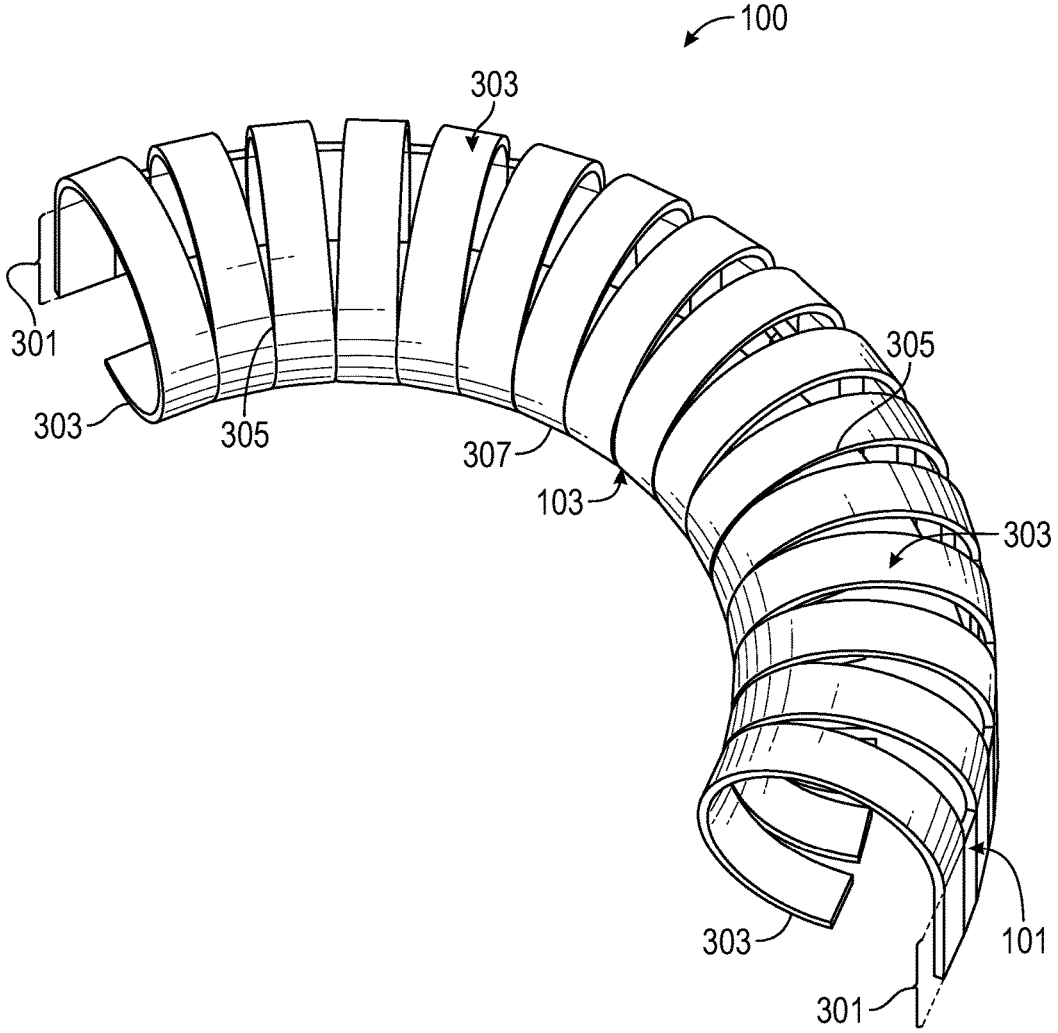
FIG. 3A may depict a bottom perspective view of an embodiment of a heat-dispersion-element.
Figure 3B:
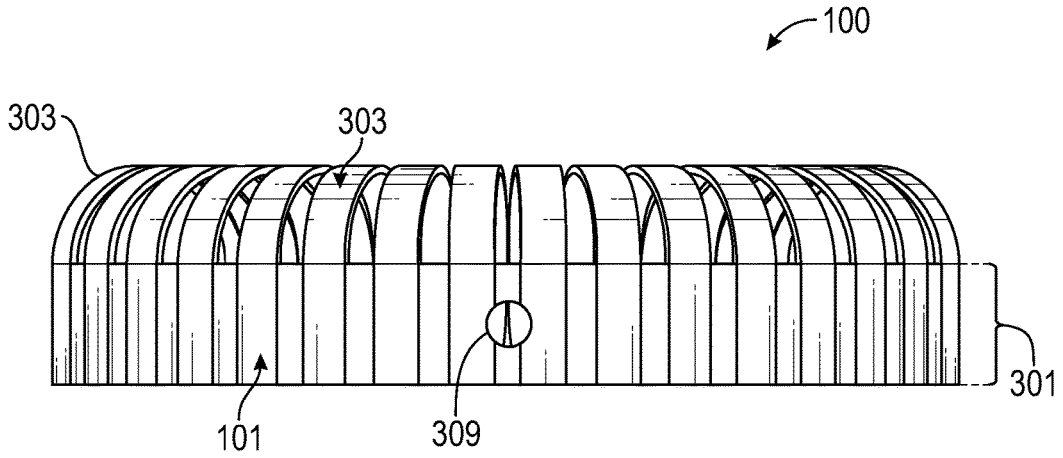
FIG. 3B may be depict the heat-dispersion-element of FIG. 3A, shown from an outside side view.
Figure 3C:
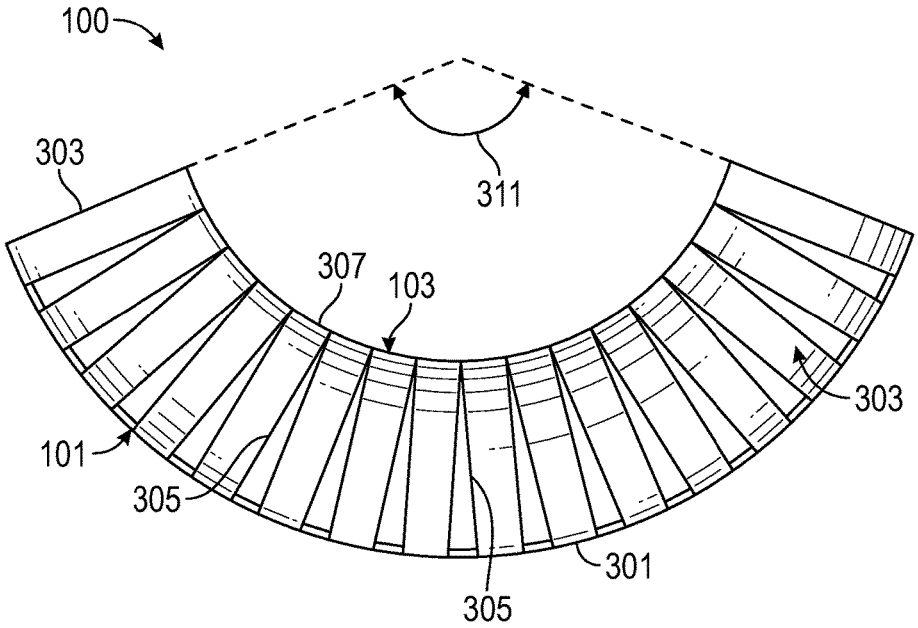
FIG. 3C may be depict the heat-dispersion-element of FIG. 3A, shown from bottom view.

FIG. 3A may depict a bottom perspective view of an embodiment of heat-dispersion-element 100. FIG. 3B may be depict heat-dispersion-element 100, shown from an outside side view. FIG. 3C may be depict heat-dispersion-element 100, shown from bottom view. In some embodiments, heat-dispersion-element 100 may be shaped substantially as a torus or substantially as a portion of a torus. In some embodiments, heat-dispersion-element 100 may be shaped substantially like a letter "p", in cross-section, where an end of the bowl of the "p" does not touch the stem of the "p" and that "p" like structure (see e.g., FIG. 6) is then revolved around in a circle. In some embodiments, heat-dispersion-element 100 may resemble an arc of a coil. In some embodiments, heat-dispersion-element 100 may resemble an arc of a spring. In some embodiments, heat-dispersion-element 100 may have characteristics of a spring. In some embodiments, heat-dispersion-element 100 may have characteristics of a coil spring. In some embodiments, heat-dispersion-element 100 may be formed from an elongate element configured as a helical coil spring around void-space-region 627 (see FIG. 6 for void-space-region 627) and then shaped into a torus or partial torus like shape.

In some embodiments, heat-dispersion-element 100 may comprises outer arc 101 and disposed opposite an inner arc 103. See e.g., FIG. 1, FIG. 3A, and FIG. 3C. In some embodiments, at least portions of outer arc 101 may be in direct physical contact with at least some portions of housing-inside-surfaces 281 of housing 180. See e.g., FIG. 2C, FIG. 5A, and FIG. 5B. In some embodiments, at least portions of inner arc 103 may be in direct physical contact with at least some portions of light-module-insert-outside-surfaces 591 of light-module-insert 190. See e.g., FIG. 5A, and FIG. 5B. In some embodiments, disposed between outer arc 101 and inner arc 103 may be void-space-region 627; which may be a region of void space. See e.g., FIG. 1 and FIG. 6. In some embodiments, void-space-region 627 may facilitate desirable heat transfer (such as, via convection and/or via radiation).

In some embodiments, heat-dispersion-element 100 may comprise a base 301 and a plurality of fingers 303 extending from base 301. See e.g., FIG. 3A, FIG. 3B, and FIG. 3C.

Continuing discussing FIG. 3A, FIG. 3B, and FIG. 3C, in some embodiments, base 301 may be a substantially elongate member. In some embodiments, base 301 may be a structural member. In some embodiments, base 301 may be a substantially planar member. In some embodiments, base 301 may be substantially shaped as a rectangular prism. In some embodiments, base 301 may be substantially semi-rigid. In some embodiments, base 301 may comprise attachment-region 309 (see e.g., FIG. 3B), as discussed above. In some embodiments, base 301 may be shaped into an arc. In some embodiments, base 301 may be curved into the arc. In some embodiments, base 301 may be bent into the arc. In some embodiments, an exterior of this arc may be outer arc 101. In some embodiments, this arc of base 301 may comprise an angle-of-arc 311 of substantially 135 degrees, plus or minus five degrees. See e.g., FIG. 3C.

In some embodiments, a given embodiment of angle-of-arc 311 may be a degree selected from the range of 360 degrees to 90 degrees. In some embodiments, when angle-of-arc 311 may be selected from the range of more than 180 degrees to 360 degrees, there may be only one heat-dispersion-element 100 disposed between housing 180 and light-module-insert 190. In some embodiments, when angle-of-arc 311 may be selected from the range of more than 90 degrees to 180 degrees, there may be two heat-dispersion-elements 100 disposed between housing 180 and light-module-insert 190; see e.g., FIG. 1.

Continuing discussing FIG. 3A, FIG. 3B, and FIG. 3C, in some embodiments, each finger 303 of the plurality of fingers 303 may extend substantially perpendicularly away from a longitude of base 301. In some embodiments where each such finger 303 extends away from base 301, adjacent fingers 303 may have a predetermined spacing; i.e., adjacent fingers 303 may be spaced. Note, such void space spacing between any given pair of adjacent fingers 303 may facilitate desirable heat transfer. In some embodiments, each finger 303 may be a substantially elongate member. In some embodiments, each finger 303 may be a substantially planar member. In some embodiments, each finger 303 may be substantially shaped as a rectangular prism. In some embodiments, each finger 303 may be substantially semi-rigid. In some embodiments, the plurality of fingers 303 may all be curved and/or bent in a same direction, such that heat-dispersion-element 101 may resemble a hollow cylinder shape, but with a bent arc due to the arcing of base 301.

Continuing discussing FIG. 3A, FIG. 3B, and FIG. 3C, in some embodiments, due to the arc of base 301 and the direction of fingers 303 extending away base 301, portions of fingers 303 may comprise engagement-region 307. In some embodiments, where base 301 may occupy outer arc 101 of heat-dispersion-element 100, then engagement-region 307 may occupy inner arc 103 of heat-dispersion-element 100. In some embodiments of heat-dispersion-element 100, engagement-region 307 may be disposed opposite of where base 301 transitions into fingers 303. In some embodiments, engagement-region 307 may physically contact at least some portions of light-module-insert-outside-surface 591 (see e.g., FIG. 5A and FIG. 5B). Physical contact between the at least some portions of light-module-insert-outside-surface 591 and at least some of engagement-regions 307 may permit heat transfer via conduction from the at least some portions of light-module-insert-outside-surface 591 to the at least some of engagement-regions 307 where there may be such physical contact. In some embodiments, light-module-insert-outside-surface 591 may comprise one or more fins 191 of light-module-insert 190.

Continuing discussing FIG. 3A and FIG. 3C, in some embodiments, the plurality of fingers 303 may comprise fin-engagement-region 305. In some embodiments, a given fin-engagement-region 305 may be a region between two adjacent fingers 303 that may accommodate receiving at least a portion of a given fin 191 of a given light-module-insert 190. In some embodiments, a given fin-engagement-region 305 may be spaced and/or sized to frictionally engage and/or hold the at least the portion of the given fin 191. In some embodiments, due to semi-rigidity of base 301 and/or of fingers 303, heat-dispersion-element 100 may be generally stiff, but may be bend and/or flex to such that portions of fins 191 may be held by fin-engagement-region 305. See e.g., FIG. 8. In some embodiments, heat-dispersion-element 100 may be characterized as a heat dispersion spring or as a heat dispersion coil.

Figure 4A:
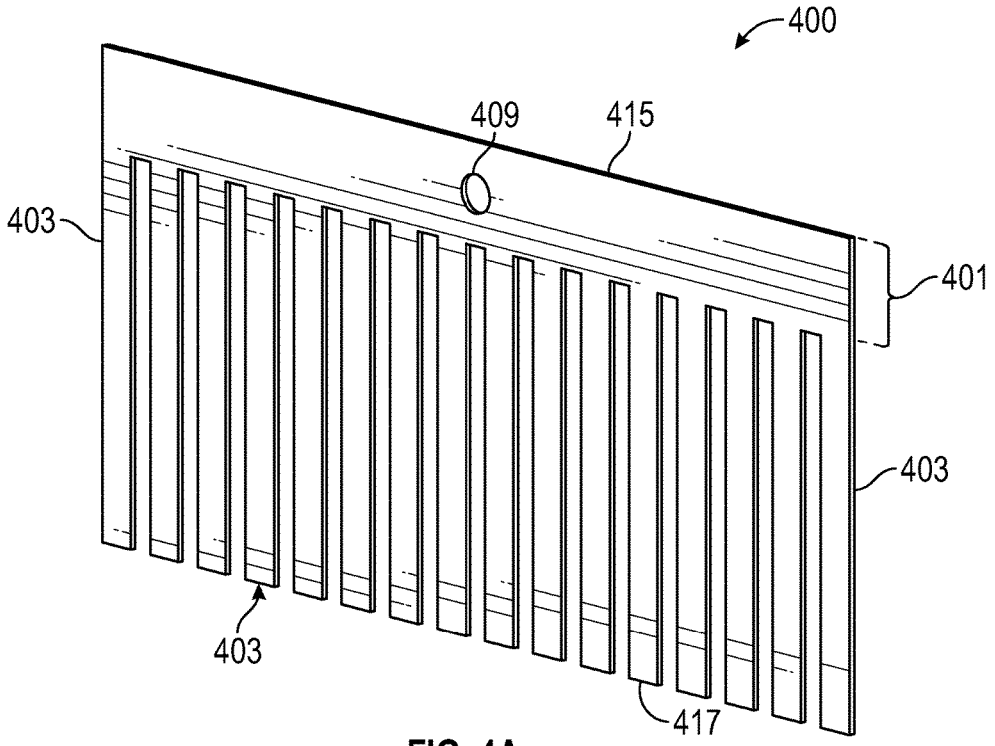
FIG. 4A may depict a perspective view of a heat-dispersion-element prior to being shaped.
Figure 4B:
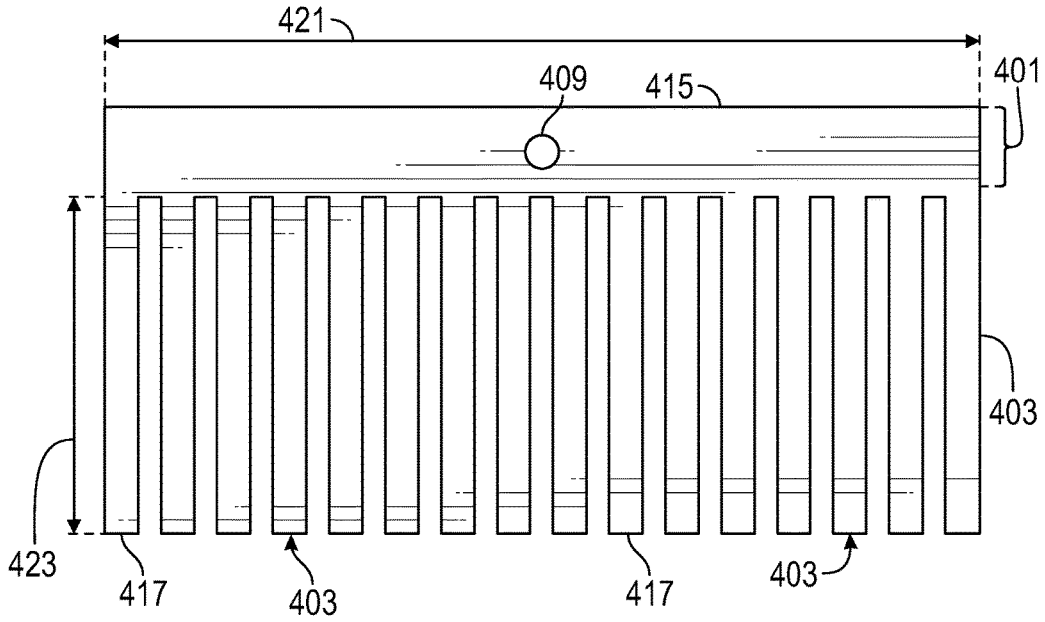
FIG. 4B may depict the heat-dispersion-element of FIG. 4A, shown from a top view (or a bottom view which may be equivalent).

FIG. 4A may depict a perspective view of a heat-dispersion-element 400 prior to being shaped to arrive at heat-dispersion-element 100. FIG. 4B may depict heat-dispersion-element 400, shown from a top view (or a bottom view which may be equivalent to the top view). In some embodiments, heat-dispersion-element 400 may be an intermediary before arriving at heat-dispersion-element 100. In some embodiments, heat-dispersion-element 400 may be molded, 3D printed, and/or die cut (stamped). In some embodiments, heat-dispersion-element 400 may then be bent, shaped, and/or pressed into a final shape of heat-dispersion-element 100.

Continuing discussing FIG. 4A and FIG. 4B, in some embodiments, heat-dispersion-element 400 may comprise a base 401 and a plurality of fingers 403 extending from base 401. In some embodiments, base 401 may be an intermediary which upon shaping, bending, and/or pressing arrives at base 301. In some embodiments, the plurality of fingers 403 may be an intermediary which upon shaping, bending, and/or pressing arrives at the plurality of fingers 303.

Continuing discussing FIG. 4A and FIG. 4B, in some embodiments, base 401 may be a substantially elongate member. In some embodiments, base 401 may be a substantially planar member. In some embodiments, base 401 may be substantially shaped as a rectangular prism. In some embodiments, base 401 may be substantially semi-rigid.

Continuing discussing FIG. 4A and FIG. 4B, in some embodiments, each finger 403 of the plurality of fingers 403 may extend substantially perpendicularly away from a longitude of base 401. In some embodiments where each such finger 403 extends away from base 401, adjacent fingers 403 may have a predetermined spacing; i.e., adjacent fingers 403 may be spaced. In some embodiments, each finger 403 may be a substantially elongate member. In some embodiments, each finger 403 may be a substantially planar member. In some embodiments, each finger 403 may be substantially shaped as a rectangular prism. In some embodiments, each finger 403 may be substantially semi-rigid.

Continuing discussing FIG. 4A and FIG. 4B, in some embodiments, along the longitude of base 401 (i.e., along a length of base 401) may be a first-end 415. In some embodiments, disposed opposite of first-end 415, at ends of each finger 403, may be second-end 417. In some embodiments, to form each finger 303, second-end 417 may be shaped, bent, and/or press to curve around in a direction to approach first-end 415.

Continuing discussing FIG. 4B, in some embodiments, the longitude of base 401 may comprise a predetermined length of base-length 421. In some embodiments, each finger 403 may comprise a length of finger-length 423. In some embodiments, base-length 421 may be longer than each finger-length 423. In some embodiments, a ratio of base-length 421 to finger-length 423 may be from 1.5 to 2.7.

Note, in some embodiments, forming heat-dispersion-element 100 may not require forming intermediary heat-dispersion-element 400. In such embodiments, heat-dispersion-element 100 may be formed by molding and/or 3D printing.

Figure 5A:
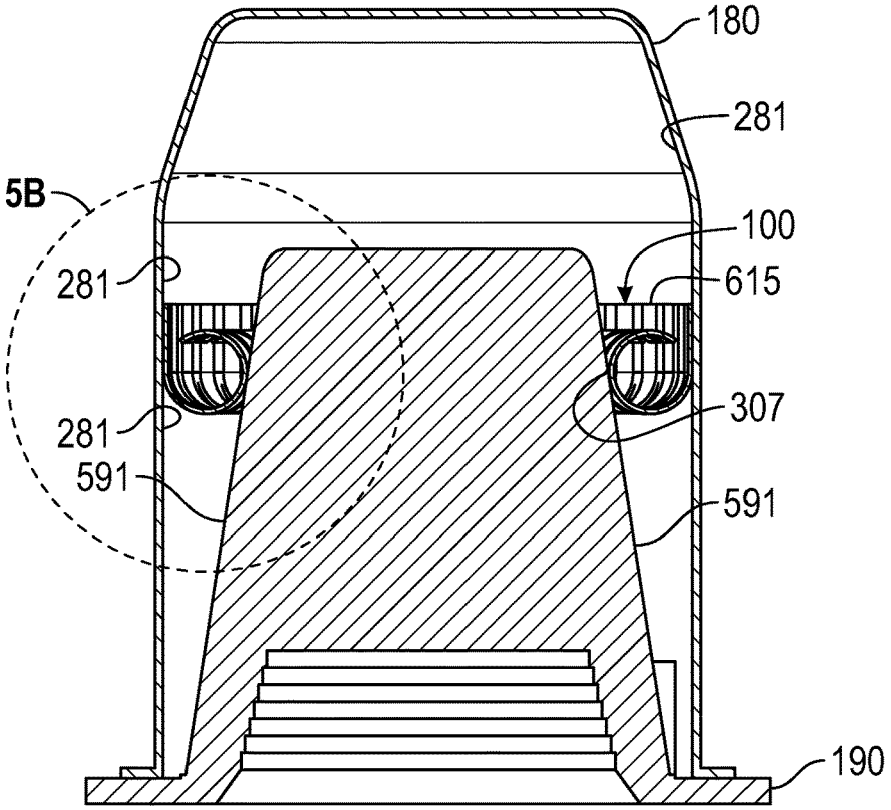
FIG. 5A may depict a longitudinal cross-sectional view through a housing; wherein the housing comprises heat-dispersion-elements and a light-module-insert.
Figure 5B:
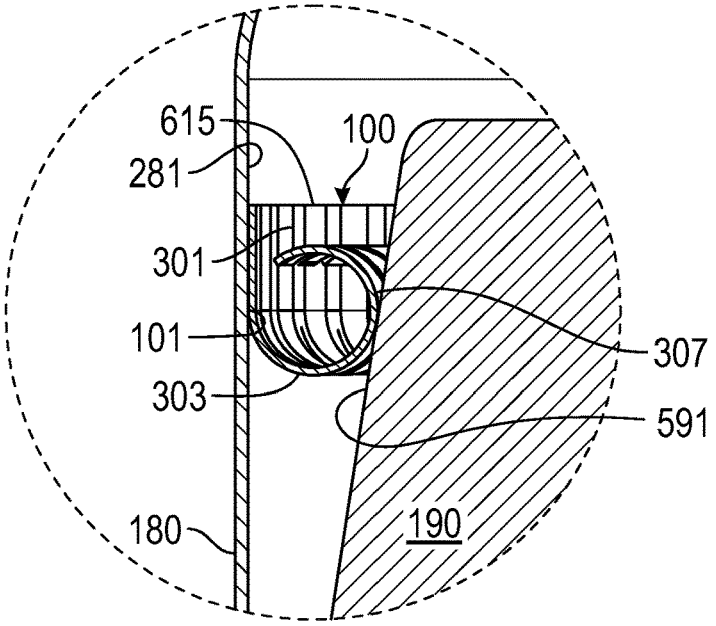
FIG. 5B may depict an enlarged (close-up) view of DETAIL 5B.

FIG. 5A may depict a longitudinal cross-sectional view through housing 180; wherein housing 180 may house heat-dispersion-elements 100 and light-module-insert 190. FIG. 5A also show region of DETAIL 5B. FIG. 5B may depict an enlarged (close-up) view of the region DETAIL 5B. As shown in FIG. 5A and in FIG. 5B, in some embodiments, heat-dispersion-elements 100 may be disposed between housing 180 and light-module-insert 190.

FIG. 5A and FIG. 5B may show that exterior and outer arc 101 portions of base 301 may be in physical contact with housing-inside-surface 281. Such regions of physical contact may permit desirable heat transfer, such as via conduction to housing 180.

FIG. 5A and FIG. 5B may show that exterior and inner arc 103 portions of heat-dispersion-elements 100 may be in physical contact with light-module-insert-outside-surface 591. In some embodiments, these inner arc 103 portions of heat-dispersion-elements 100 may be engagement-region 307. Such regions of physical contact may permit desirable heat transfer, such as via conduction from light-module-insert 190. In some embodiments, light-module-insert 190 may comprise light-module-insert-outside-surface 591. In some embodiments, light-module-insert-outside-surface 591 may be outside surfaces of light-module-insert 190. In some embodiments, light-module-insert-outside-surface 591 may comprise fins 191 of light-module-insert 190.

Figure 6:
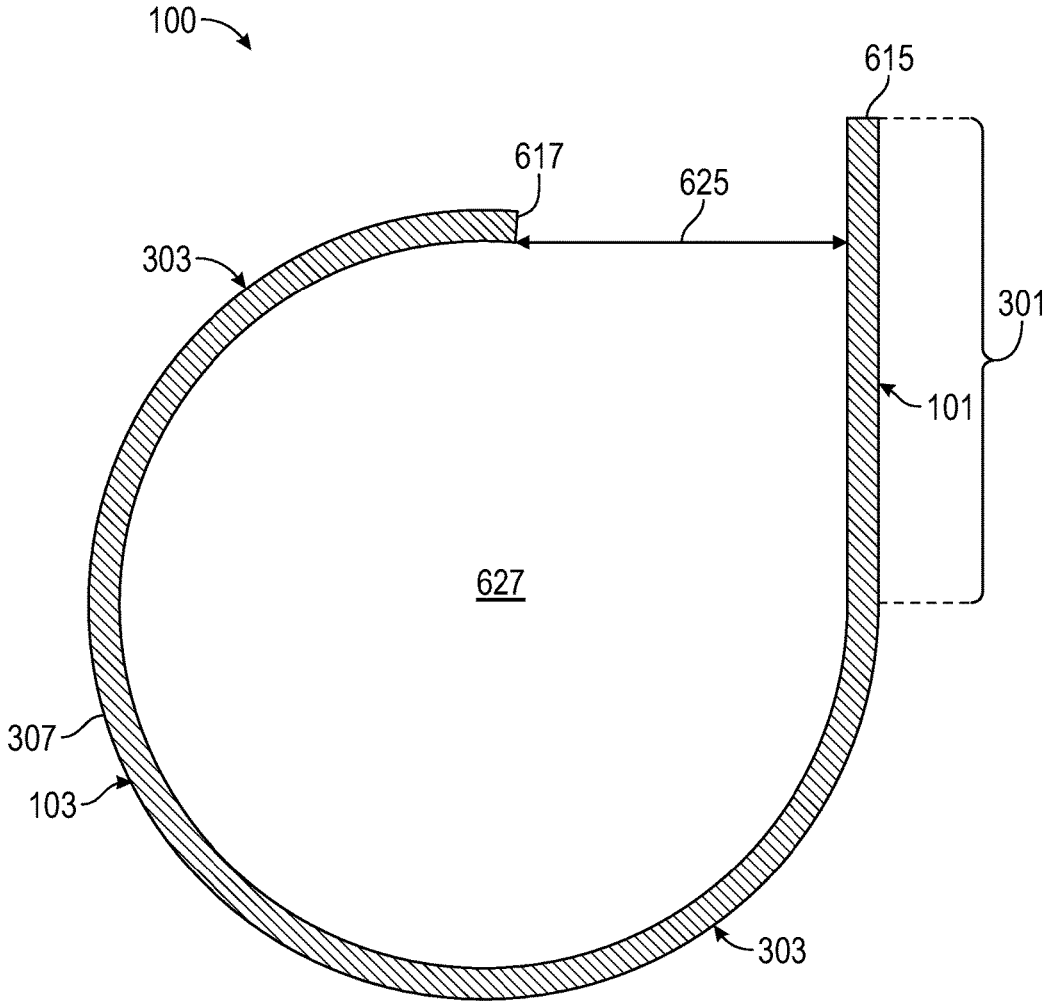
FIG. 6 may depict a cross-sectional view through an embodiment of a heat-dispersion-element.

FIG. 6 may depict a cross-sectional view through an embodiment of heat-dispersion-element 100. In some embodiments, along a top edge of base 301 may be a first-end 615. In some embodiments, first-end 615 may be located along the longitudinal outside edge of base 301. In some embodiments, at ends of each finger 303, may be a second-end 617. In some embodiments, to form each finger 303, second-end 617 may be shaped, bent, and/or pressed to curve around in a looping direction to approach base 301 and/or to approach first-end 615. In some embodiments, second-end 617 may be separated from base 301 by separation-gap 625. When no load may be placed upon heat-dispersion-element 100, separation-gap 625 may be predetermined; however, when heat-dispersion-element 100 may be physically contacting housing 180 and/or light-module-insert 190, separation-gap 625 may vary according to the load and semi-rigidity of fingers 303 and base 301.

Continuing discussing FIG. 6, in some embodiments, the plurality of fingers 303 and base 301 may partially circumscribe void-space-region 627 which is the region of void space; wherein void-space-region 627 may facilitate desirable heat transfer via radiation and convection.

In some embodiments, first-end 415 may be an intermediary which upon shaping, bending, and/or pressing arrives at first-end 615. In some embodiments, second-end 417 may be an intermediary which upon shaping, bending, and/or pressing arrives at second-end 617.

Figure 7:
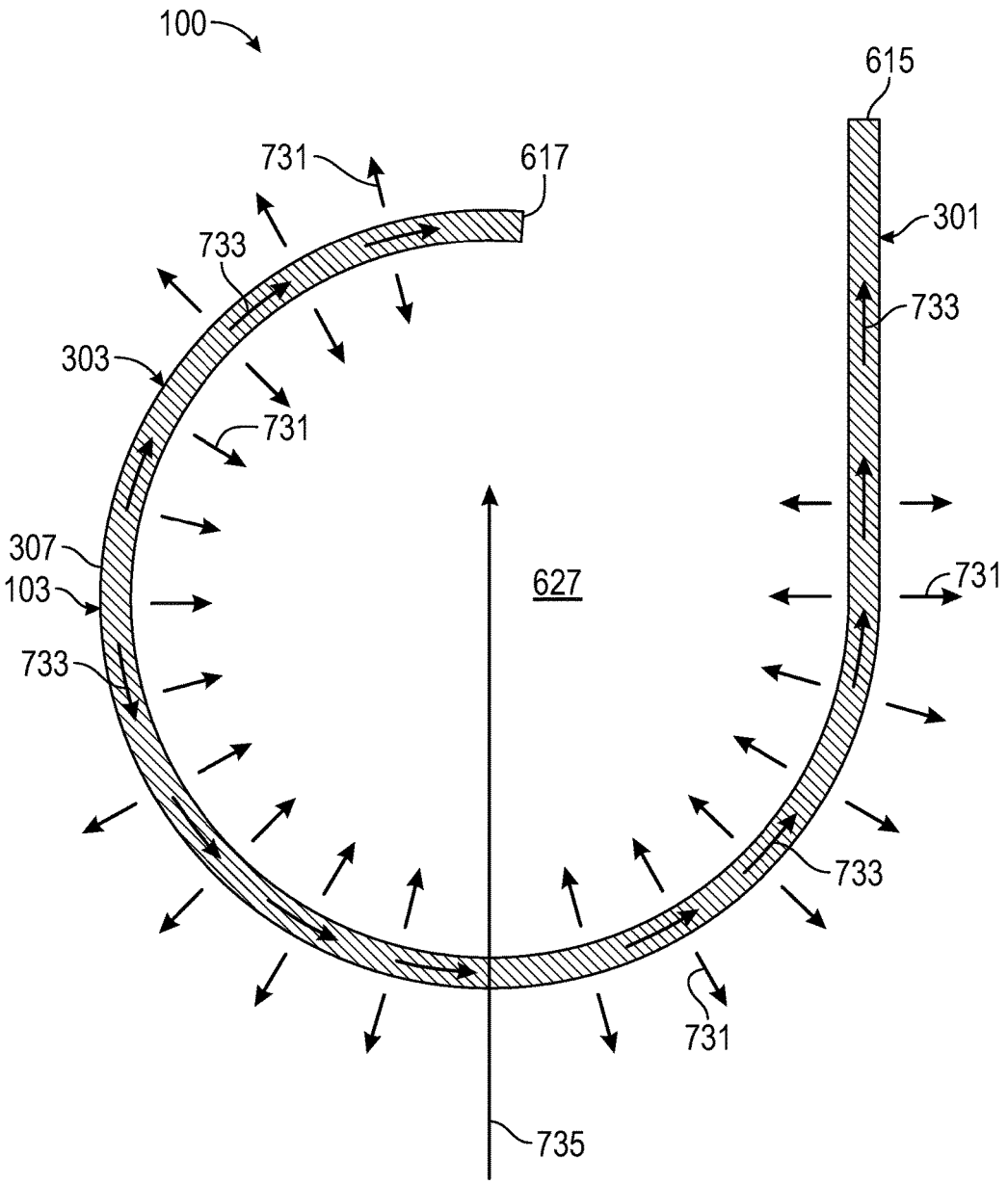
FIG. 7 may depict a cross-sectional view through an embodiment of a heat-dispersion-element and that also shows various arrows indicating directions of heat transfer.

FIG. 7 may depict a cross-sectional view through an embodiment of heat-dispersion-element 100 (e.g., similar to FIG. 6) and that also may show various arrows indicating directions and/or types of heat transfer. Recall, in some embodiments, portions of engagement-region 307 may be in physical contact with portions of light-module-insert-outside-surface 591, wherein conductive heat transfer is facilitated through such physical contact. Recall, in some embodiments, portions of base 301 may be in physical contact with portions of housing-inside-surface 281, wherein conductive heat transfer is facilitated through such physical contact. In FIG. 7, arrows indicated as 731 may indicate radiant heat transfer, as in radiant-heat-direction 731. Arrows indicated as 733 may indicate conductive heat transfer, as in conductive-heat-direction 733. Arrow indicated as 735 may indicate convective heat transfer, as in convective-direction 735.

Continuing discussing FIG. 7, in some embodiments, radiant-heat-direction 731 may be radiating away from the material(s) of construction of heat-dispersion-element 100. In some embodiments, conductive-heat-direction 733 may be heat transfer through the material(s) of construction of heat-dispersion-element 100. Portions of conductive-heat-direction 733 may result in heat transfer to exterior surfaces of heat-dispersion-element 100, wherein heat may then radiate outwards and away from heat-dispersion-element 100 via radiant-heat-direction 731. Radiant heat transfer may then heat ambient air disposed between light-module-insert 190 and housing 180. Such heated ambient air may then result in further convective heat transfer and convective ambient air movement. That is, heated ambient air is less dense and will rise, creating a general updraft of ambient air movement, such as convective-direction 735, which is further facilitated by the spaced arrangement of fingers 303 that permits ambient air movement through such spacing and of void-space-region 627.

Figure 8:
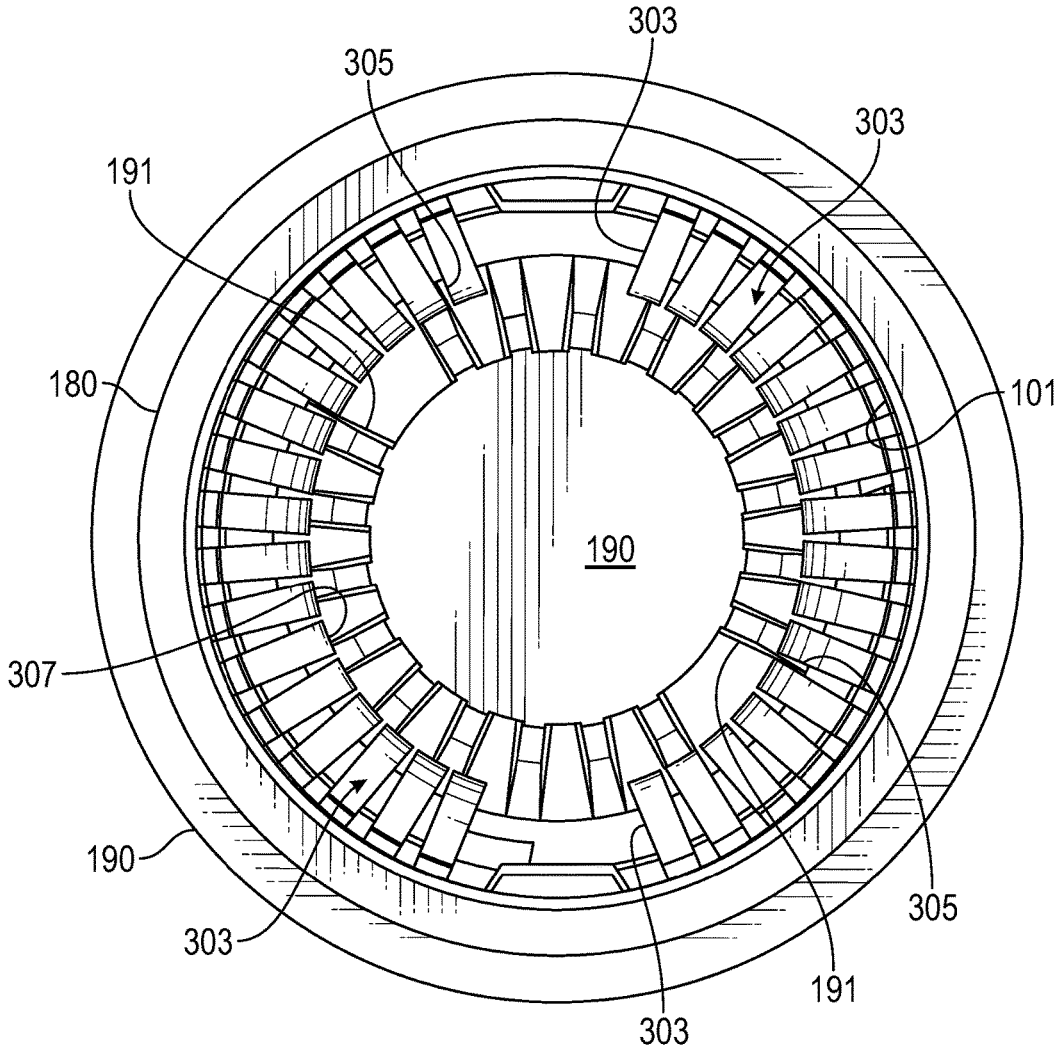
FIG. 8 may depict a transverse width cross-sectional view through a housing; wherein the housing comprises heat-dispersion-elements and a light-module-insert.

FIG. 8 may depict a transverse width cross-sectional view (i.e., a top cross-sectional view) through housing 180; wherein housing 180 may house heat-dispersion-elements

100 and light-module-insert 190. FIG. 8 may show some portions of some fins 191 being received by fin-engagement-regions 305.

In some embodiments, a heat-dispersion-element may be shaped substantially as a torus or substantially as a portion of a torus; wherein the heat-dispersion-element may be comprised of a wool or a substantially elongate member of material suitable for heat transfer, such as, but not limited to, a metal wool. Such a metal wool, substantially shaped as a torus or portion thereof, may be disposed between housing 180 and light-module-insert 190.

In some embodiments, heat-dispersion-elements (e.g., 100 and/or 400) may be substantially constructed from one or more materials suitable for heat transfer; such as, but not limited to, copper, aluminum, silver, steel, alloys thereof, combinations thereof, and/or the like.

In some embodiments, heat-dispersion-elements (e.g., 100 and/or 400) may act as a heat sink.

Note with respect to the materials of construction, it is not desired nor intended to thereby unnecessarily limit the present invention by reason of such disclosure.

In some embodiments, a method for transferring heat away from light-module-insert 190 may comprise locating one or more heat dispersion elements 100 between housing 180 and light-module-insert 190. In some embodiments, light-module-insert 190 may be housed within housing 180. In some embodiments, heat-dispersion-element 100 may comprise outer arc 101 and disposed opposite inner arc 103. In some embodiments, at least portions of outer arc 101 may be in direct physical contact with at least some portions of housing-inside-surfaces 281 of housing 180. In some embodiments, at least portions of inner arc 103 may be in direct physical contact with at least some portions of light-module-insert-outside-surfaces 591 of light-module-insert 190. See e.g., FIG. 1, FIG. 2B, FIG. 2C, FIG. 5A, FIG. 5B, FIG. 7, and FIG. 8.

In some embodiments, a system for cooling light-module-insert 190 may comprise at least one heat-dispersion-element (such as 100) and light-module-insert 190. In some embodiments, a system for cooling light-module-insert 190 may comprise at least one heat-dispersion-element (such as 100) and housing 180. In some embodiments, a system for cooling light-module-insert 190 may comprise at least one heat-dispersion-element (such as 100) housing 180, and light-module-insert 190; wherein the at least one heat-dispersion-element (such as 100) may be disposed between housing 180 and light-module-insert 190.

Various heat-dispersion-elements have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A heat-dispersion-element for cooling a light-module-insert: wherein the heat-dispersion-element comprises:

a base that is a structural member; wherein the base is formed into an outer arc; wherein at least portions of the outer arc are in direct physical contact with at least some portions of housing-inside-surfaces of a housing;

a plurality of fingers extending from the base; wherein a portion of the plurality of fingers are disposed opposite of the outer arc forming an inner arc;

wherein at least portions of the inner arc are in direct physical contact with at least some portions of light-module-insert-outside-surfaces of the light-module-insert; wherein the heat-dispersion-element is disposed between the light-module-insert and the housing; and wherein along an outside longitudinal edge of the base is a first-end; and each finger selected from the plurality of fingers terminates in a second-end; wherein the second-end loops around to approach the base.

2. The heat-dispersion-element according to claim 1, wherein the outer arc and the inner arc are substantially concentric with respect to each other.

3. The heat-dispersion-element according to claim 1, wherein the base and the plurality of fingers are each one or more of: elongate; substantially planar; substantially shaped as a rectangular prism; or substantially semi-rigid with spring characteristics.

4. The heat-dispersion-element according to claim 1, wherein each finger selected from the plurality of fingers extends substantially perpendicular away from a longitude of the base.

5. The heat-dispersion-element according to claim 1, wherein the plurality of fingers comprises adjacent fingers, wherein any pair of the adjacent fingers have predetermined spacing.

6. The heat-dispersion-element according to claim 1, wherein disposed opposite of where the base transitions into the plurality of fingers is an engagement-region; wherein the engagement-region is a region of the inner arc where the at least portions of the inner arc are in direct physical contact with the at least some portions of the light-module-insert-outside-surfaces of the light-module-insert.

7. The heat-dispersion-element according to claim 1, wherein the plurality of fingers comprises fin-engagement-regions; wherein the fin-engagement-regions are regions between two adjacent fingers selected from the plurality of fingers that accommodate receiving at least a portion of a fin of the light-module-insert.

8. The heat-dispersion-element according to claim 1, wherein a longitudinal length of the base is longer than a length of each finger selected from the plurality of fingers.

9. The heat-dispersion-element according to claim 1, wherein the plurality of fingers and the base partially circumscribe a void-space-region which is a region of void space; wherein the void-space-region facilitates desirable heat transfer via radiation and convection.

10. The heat-dispersion-element according to claim 1, wherein the heat-dispersion-element comprises one or more substantially elongate members substantially constructed from at least one type of metal wool.

11. The heat-dispersion-element according to claim 1, wherein the heat-dispersion-element is substantially constructed from at least one material suitable for heat transfer or to act as a heat sink.

12. The heat-dispersion-element according to claim 1, wherein the heat-dispersion-element is substantially constructed from at least one metal.

13. A method for transferring heat away from a light-module-insert:

the method comprises locating one or more heat dispersion elements between a housing and the light-module-insert; wherein the light-module-insert is housed substantially within the housing; wherein at least one of the one or more heat-dispersion-elements comprises:

a base that is a structural member; wherein the base is formed into an outer arc; wherein at least portions of the outer arc are in direct physical contact with at least some portions of housing-inside-surfaces of the housing;

a plurality of fingers extending from the base; wherein a portion of the plurality of fingers that is disposed opposite of the outer arc forms an inner arc;

wherein at least portions of the inner arc are in direct physical contact with at least some portions of light-module-insert-outside-surfaces of the light-module-insert; and wherein along an outside longitudinal edge of the base is a first-end; and each finger selected from the plurality of fingers terminates in a second-end; wherein the second-end loops around to approach the base.

14. The heat-dispersion-element according to claim 1, wherein the second-end is separated from the base by a separation-gap.

15. The heat-dispersion-element according to claim 1, wherein the housing substantially houses the light-module-insert.

* * * * *